US006905222B1

(12) United States Patent
Russello et al.

(10) Patent No.: US 6,905,222 B1
(45) Date of Patent: Jun. 14, 2005

(54) THERMAL ISOLATION LUMINAIRE AND WALL MOUNT SYSTEM

(75) Inventors: Thomas Russello, Freehold, NJ (US); Michael K. Yoshida, Monmouth Junction, NJ (US)

(73) Assignee: Genlyte Thomas Group LLC, Louisville, KY (US)

( * ) Notice: Subject to any disclaimer, the term of this patent is extended or adjusted under 35 U.S.C. 154(b) by 112 days.

(21) Appl. No.: 10/255,764

(22) Filed: Sep. 26, 2002

Related U.S. Application Data

(60) Provisional application No. 60/369,269, filed on Apr. 2, 2002.

(51) Int. Cl.[7] ..... F21S 8/06

(52) U.S. Cl. ..... 362/147; 362/186; 362/373; 362/368; 362/430

(58) Field of Search ..... 362/147, 186, 362/373, 368, 430, 404; 248/303

(56) References Cited

U.S. PATENT DOCUMENTS

| | | | | |
|---|---|---|---|---|
| 5,307,254 | A * | 4/1994 | Russello et al. | 362/368 |
| 6,375,141 | B1 * | 4/2002 | Kettlestrings | 248/303 |
| 6,530,681 | B2 * | 3/2003 | Sieczkowski | 362/404 |
| 6,733,158 | B2 * | 5/2004 | Fischer et al. | 362/404 |

* cited by examiner

*Primary Examiner*—Stephen Husar
*Assistant Examiner*—Anabel Ton
(74) *Attorney, Agent, or Firm*—John F. Salazar; Middleton & Reutlinger

(57) ABSTRACT

A wall mount luminaire and thermal isolation system having a wall mount and fixture mount operably connected to form a splice chamber. Fixture mount plate may be opened relative to the wall mount plate and wherein the wall mount plate supports the weight of a reflector housing attached to the fixture plate mount. A ballast housing may alternatively be attached to the fixture mount plate between the fixture mount plate and the reflector housing. In this configuration heat from the reflector housing is thermally isolated from the ballast housing containing the electronic components.

31 Claims, 8 Drawing Sheets

THERMAL ISOLATION LUMINAIRE AND WALL MOUNT SYSTEM

CROSS-REFERENCE TO RELATED APPLICATIONS

This application claims the benefit of U.S. Provisional Application No. 60/369,269, filed Apr. 2, 2002.

STATEMENT REGARDING FEDERALLY SPONSORED RESEARCH OR DEVELOPMENT

Not applicable.

BACKGROUND OF THE INVENTION

1. Technical Field of the Invention

The present invention relates generally to a landscape luminaire. More particularly, the invention relates to a landscape luminaire having a wall mount system which supports the weight of the luminaire during installation, has thermal isolation characteristics, and a modular hinged ballast tray.

2. Description of the Related Art

Landscape luminaires are typically used to illuminate landscaping and building facades to provide an aesthetically pleasing appearance. Landscape luminaires may be situated on churches, office buildings, malls, hospitals, schools, and the like to illuminate the structure walls and adjacent landscaping. However, these building mounted landscape luminaires generally have several problems associated therewith. First, these lights are often quite large in order to effect a desired lighting level and therefore may be extremely heavy. This makes installation very difficult, sometimes requiring two-men. Second, the weight also makes servicing and cleaning very difficult, especially when the fixture must be opened and supported. Third, larger luminaires produce significant amounts of heat which may be damaging to the fixture and electrical components therein over the life of the fixture.

Older light designs have attempted to overcome the weight problems associated with outdoor landscaping luminaires. Various shapes and sizes have been developed; however, these designs often ship fully assembled yet must be disassembled to effectuate installation of lightweight manageable parts. This disassembly and re-assembly in the field can lead to water leaks, incorrect time-consuming installation, or even lost parts.

In view of the deficiencies in known landscape luminaires, it is apparent that a landscape luminaire is needed wherein a mounting system supports the weight of the luminaire during installation and subsequent servicing, and the luminaire has a modular design allowing thermal isolation of the lamp and electronic components to allow better heat dissipation of the light fixture and electrical components therein.

SUMMARY OF THE INVENTION

It is an object of the present invention to provide a landscape luminaire.

It is a further object of the present invention to provide a landscape luminaire having a wall mounting system which supports the weight of the luminaire during installation and servicing.

It is an even further object of the present invention to provide a landscape luminaire having a modular design which may allow for separate mounting of reflector housing and ballast housing.

Specifically, the present invention provides a landscape luminaire having a wall mount and thermal isolation system comprising a wall mount plate having parallel opposed arm slots, and a substantially U-shaped wireform having a first, a second and a third arm. The first and second arms are slidably connected to the wall mount plate within the parallel opposed arm slots. The third arm of the wireform is pivotably connected to a fixture mount plate. The wireform first and second arms have elbows therein which contact the wall mount plate and dispose a reflector housing away from a building wall when the fixture is open during installation or service. The wall mount plate has a knock-out plate where wires enter providing power to the fixture electronic components.

The landscape luminaire further comprises a reflector or optics housing. In a first embodiment the reflector or optics housing may be directly connected to the fixture mount plate. Within the reflector housing may be a modular hinged ballast tray. Mounted on the modular ballast tray may be a power supply, a ballast, a lamp socket, and lamp. Above the modular ballast tray is a reflector. Between the reflector and a lens tray mounted lens is the lamp and the lamp socket which may also be mounted on the modular ballast tray. In electrical communication with the lamp and lamp socket are the power supply and the lamp ballast. With this modular configuration, the modular hinged ballast tray, which contains the reflector, power supply, ballast, lamp socket and lamp, may be easily replaced during servicing if a component fails thereby removing the need for the service technician to replace individual components within the reflector housing and making servicing simplified.

In an alternative embodiment, the reflector or optics housing also comprises a reflector therein and a lens tray connected to a lower peripheral edge of the reflector housing. The lens tray has a lens seated therein. Between the reflector and lens is a lamp. The lamp is preferably a HID lamp, for instance, a metal halide lamp, but may be any other lamp known to one of ordinary skill in the art. The lamp is operably connected to a lamp socket, the lamp socket being mounted in a electronics or ballast housing. The ballast housing may be a plurality of shapes and has a modular ballast tray mounted therein. The modular ballast tray has a power supply and ballast mounted thereon. The ballast housing may have a plurality of vents for heat dissipation along a top semi-circular surface. On a first side of the ballast housing is a fixture bracket allowing the lamp socket to be attached on a first side thereof and the reflector housing to be attached on a second side thereof. On a second side of the ballast housing may be the fixture mounting plate which is pivotably attached to the wireform. The wall mount plate may further comprise a level bubble thereon for assisting in mounting. The wall mount plate may be of similar design to the other embodiment such that the installations are interchangeable.

All of the above outlined objectives are to be understood as exemplary only and many more objectives of the invention may be learned from the disclosure herein. Therefore, no limiting interpretation of the objectives noted is to be understood without further reading of the entire specification, claims, and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Wall Mount System

Figure 1:
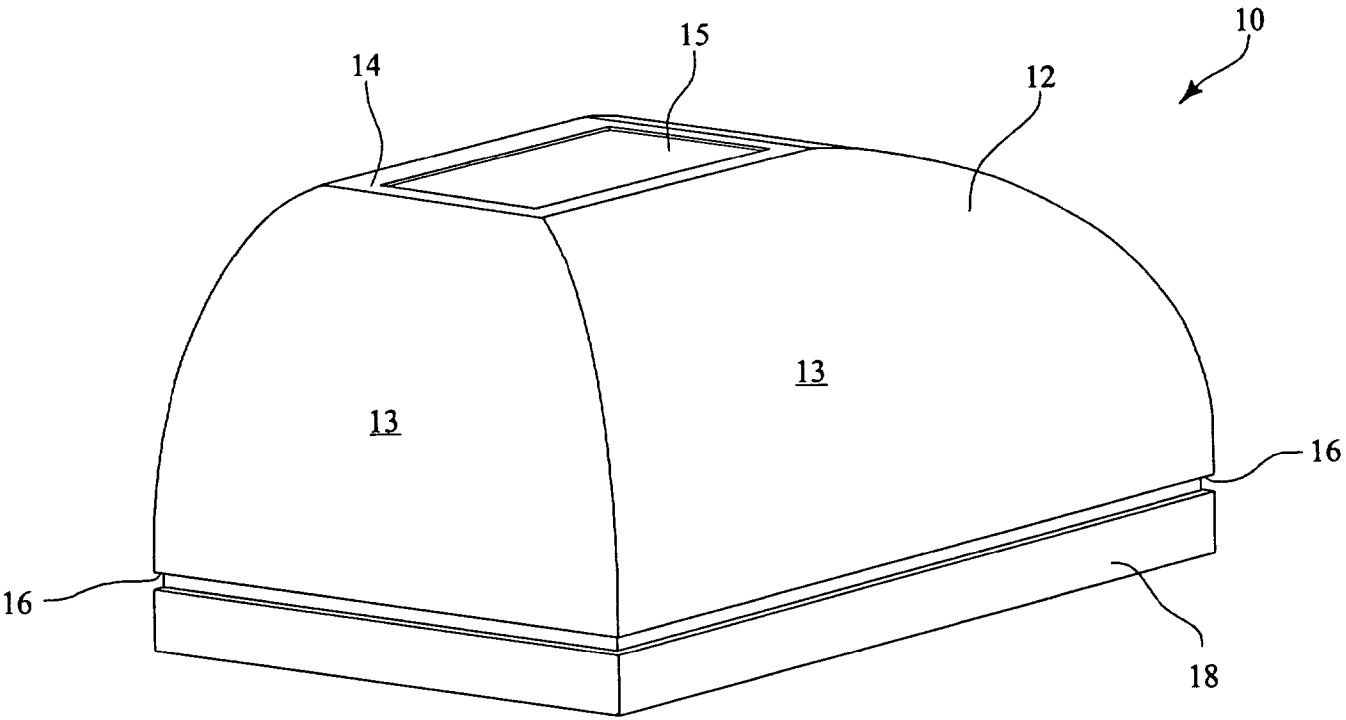
FIG. 1 shows a perspective view of a first embodiment of the wall mount luminaire of the present invention.

The present invention will now be described in conjunction with the drawings, referring initially to FIGS. 1 and 2, a wall mount landscape luminaire fixture 10 is shown. The luminaire fixture 10 includes a reflector or optics housing 12 having three rounded sides surfaces 13 and preferably a flat top portion 14 wherein a translucent lens 15 may be disposed for various desired uptight characteristics. Of course, uptight and downlight characteristics may be readily modified with interchanging of various components hereof and no limitation is to be interpreted from the specific light output characteristics described as they are used only for exemplary purposes only.

Figure 6:
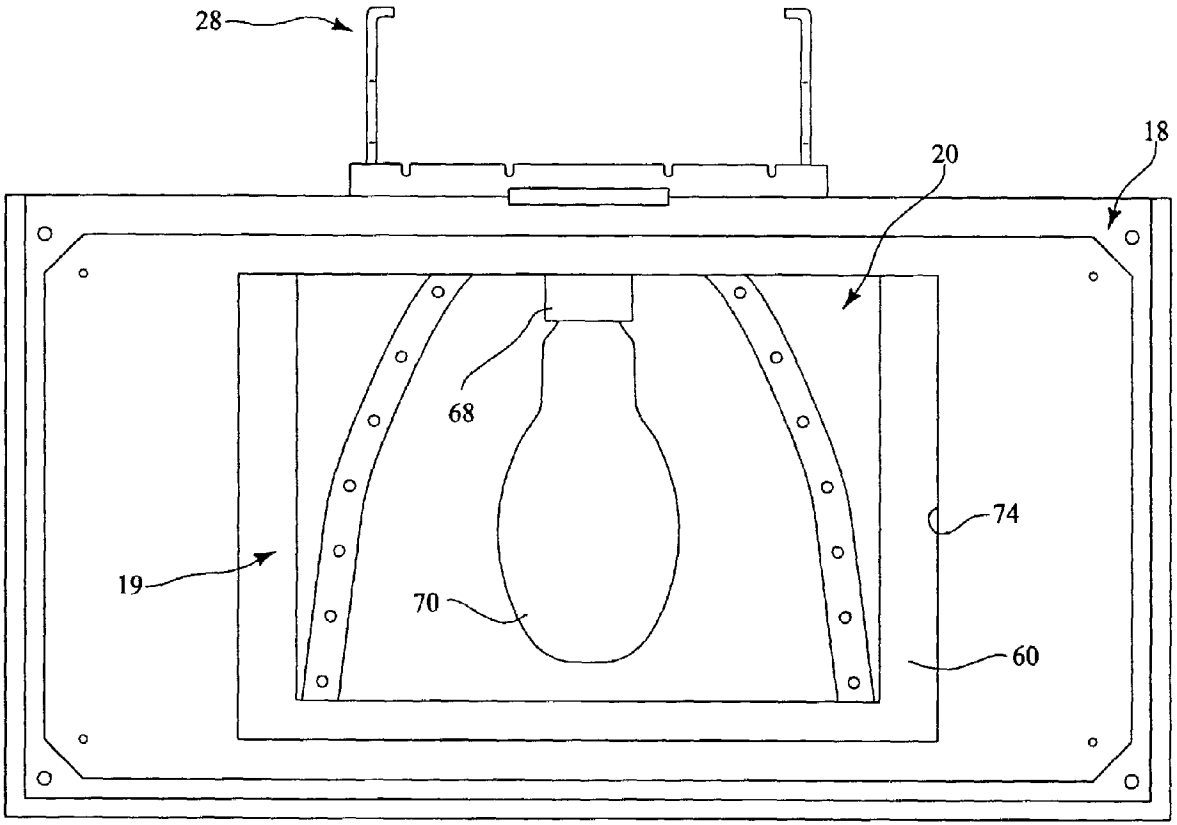
FIG. 6 shows a bottom view of the wall mount luminaire of FIG. 1.
Figure 7:
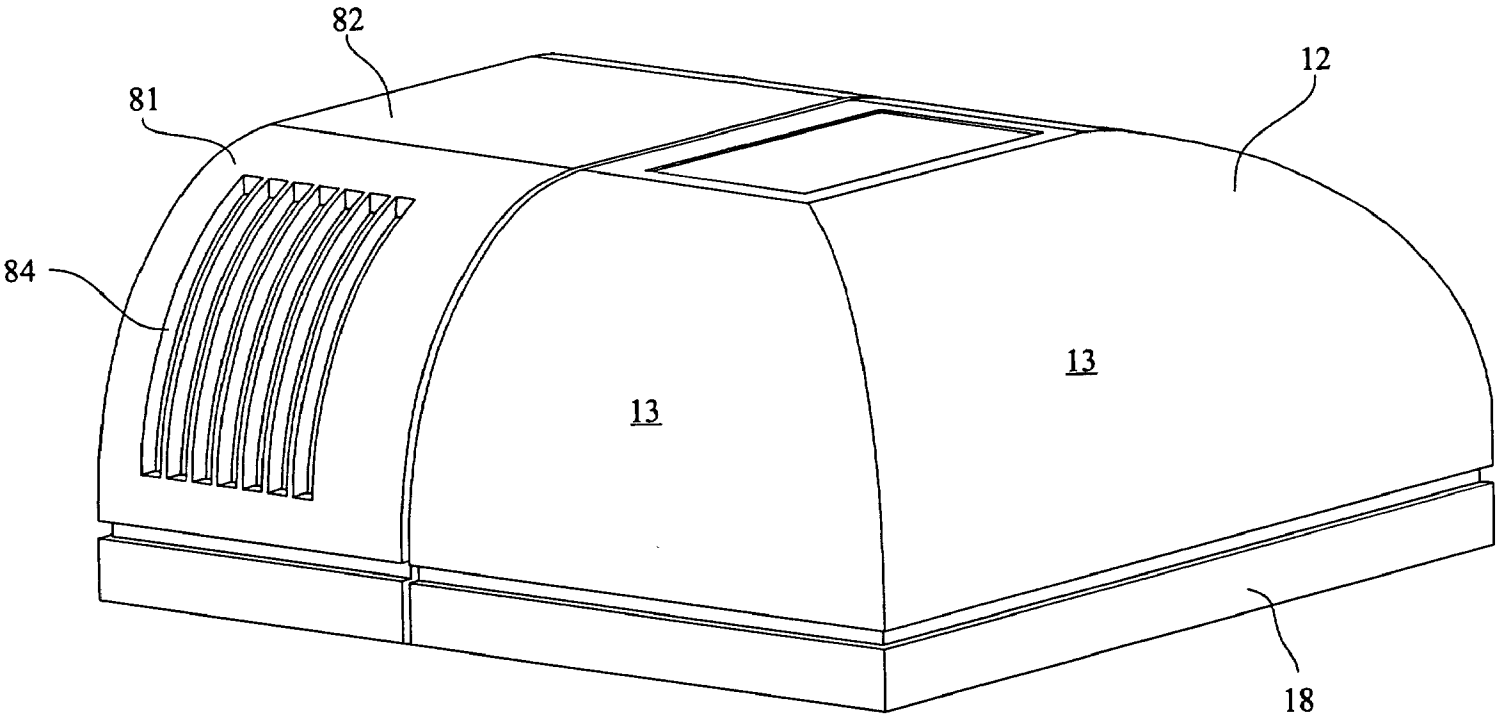
FIG. 7 shows a perspective view of an alternative embodiment of wall mount luminaire with thermal isolation system of the present invention.
Figure 8:
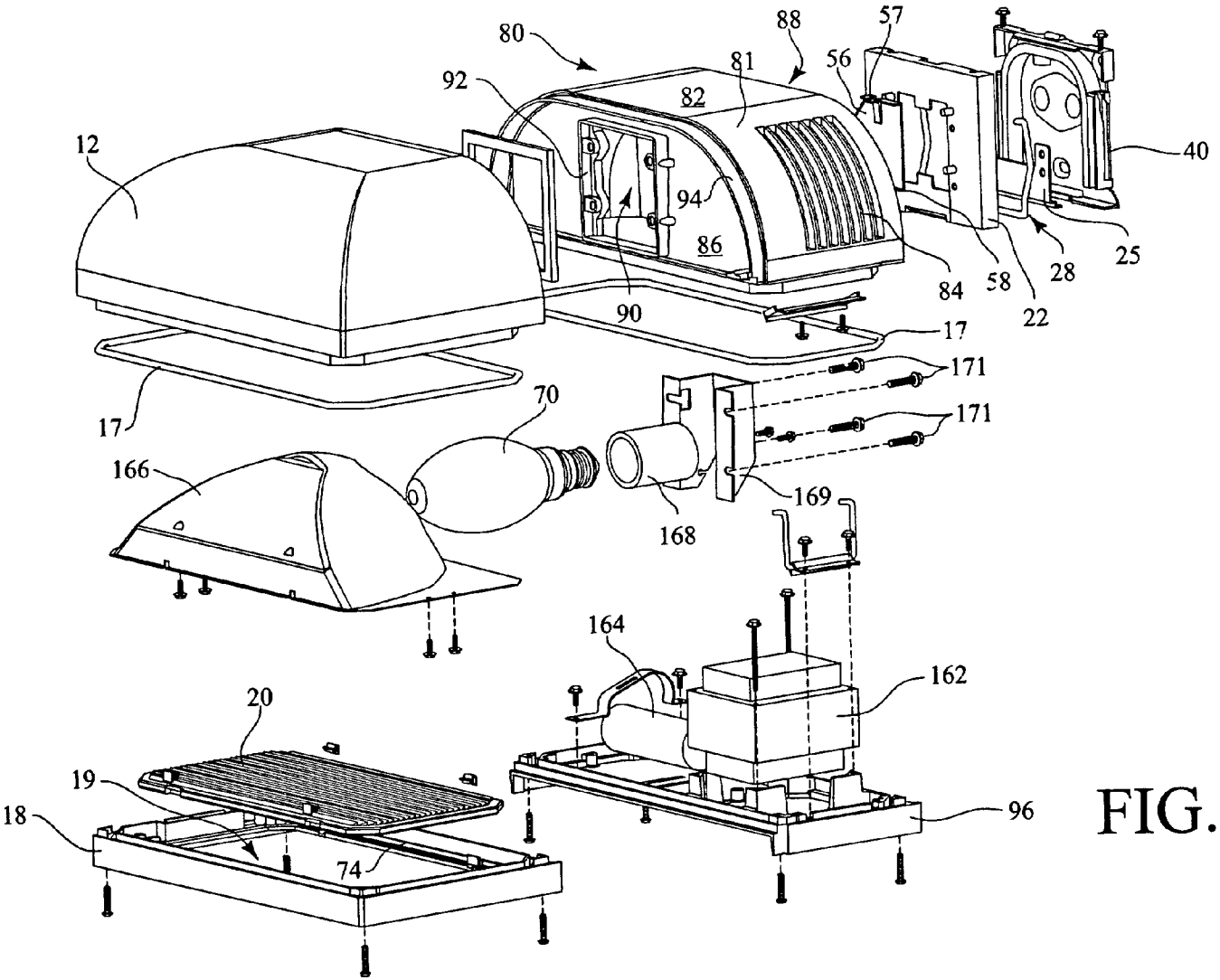
FIG. 8 shows an assembly view of the wall mount luminaire with thermal isolation of FIG. 6; and, FIG. 9 shows a perspective view of the fixture of FIG. 1 in an open position revealing the wire shield door.
Figure 9:
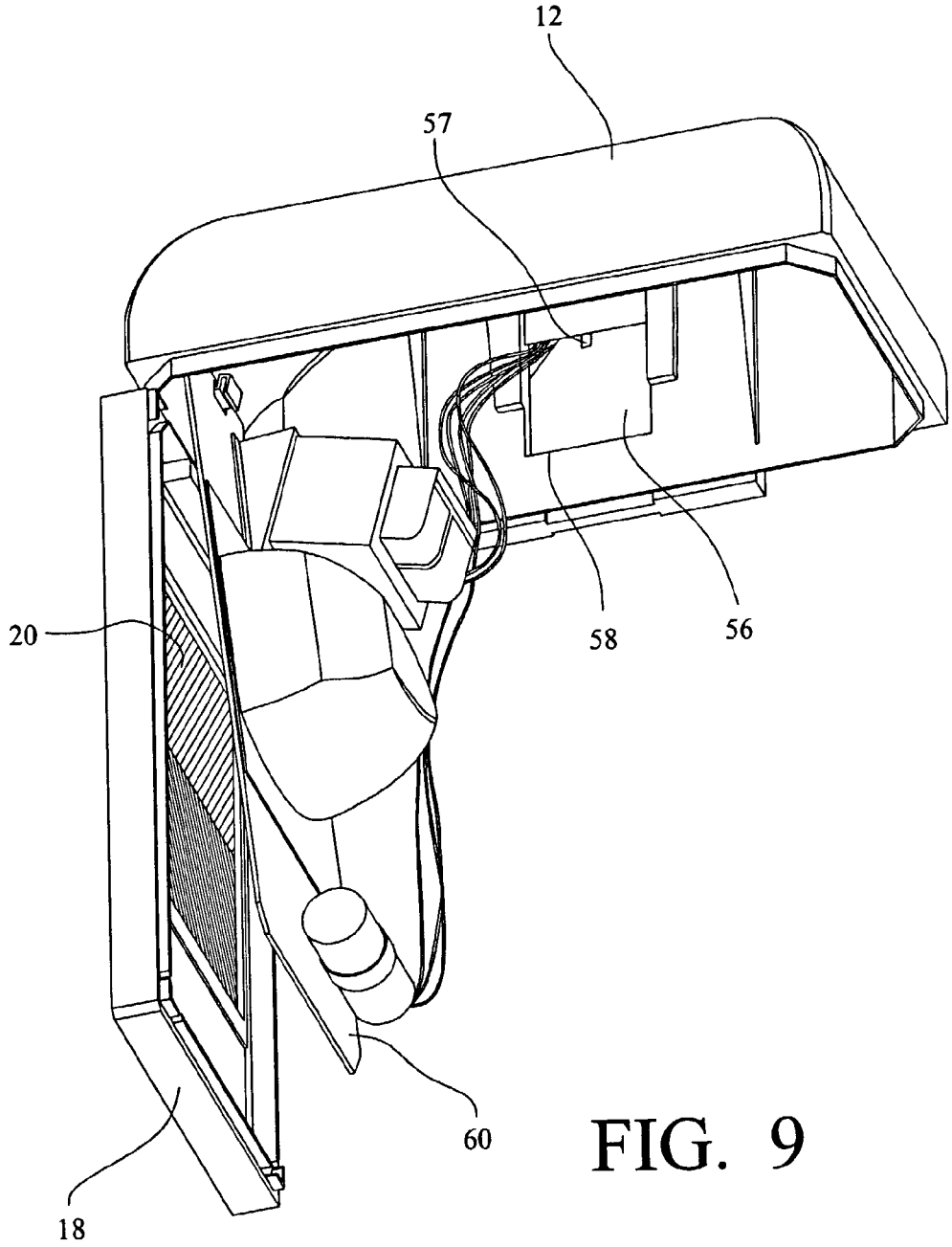

The reflector housing 12 is formed preferably of heavy duty die cast aluminum having a corrosion resistant finish, however various other materials may be used preferably being corrosion resistant. The bottom of the reflector housing 12 is open wherein various light components are positioned. Fastened along a lower edge 16 of the reflector housing 12 is a lens tray 18 wherein a lens 20 is preferably disposed, as shown in FIGS. 1,6,7. Moreover, the lens tray 18 is preferably hingeably connected to the reflector housing 12 as shown in FIG. 9 to provide easy servicing. A gasket 17 may be disposed between the lens tray 18 and the reflector housing 12 to prevent water, dirt, and other contaminants from entering the housing 12 as shown in FIG. 8.

Figure 2:
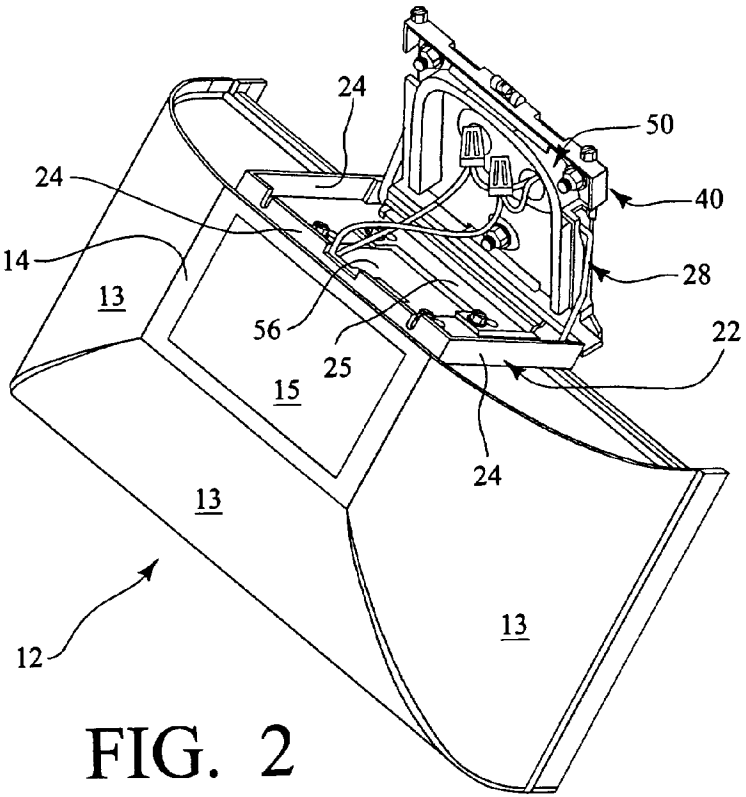
FIG. 2 shows a perspective view of the luminaire of FIG. 1 upon partial installation with the wall mount in the open position.
Figure 5:
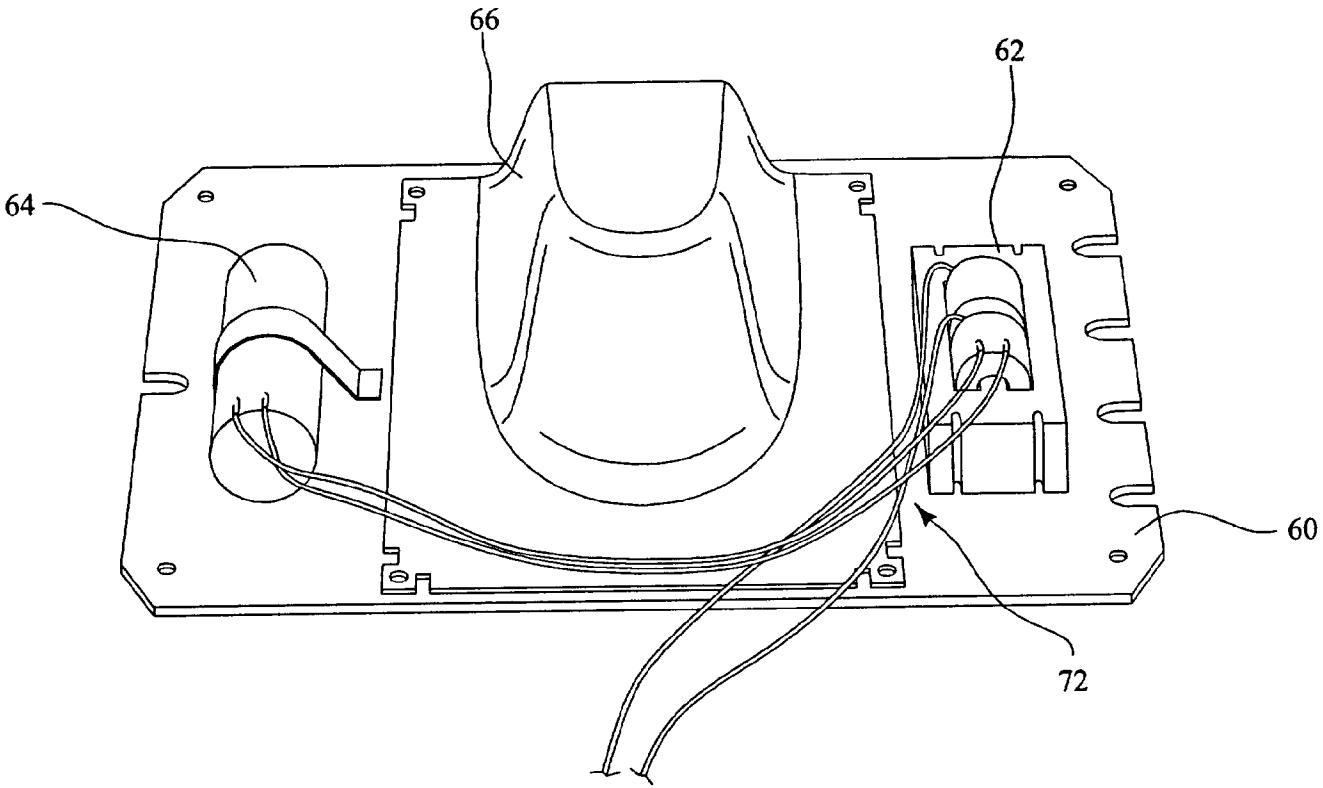
FIG. 5 shows a perspective view of a modular housing tray used with the first embodiment of FIG. 1.

As shown in FIGS. 2 and 5, a back side of the reflector housing 12 has a fixture mount plate 22 connected thereto having a substantially square shape however, one skilled in the art will recognize that the fixture mount plate 22 may be a plurality of shapes. The fixture mount plate 22 is preferably connected to the reflector housing 12 by a plurality of screws extending through the fixture plate 22 and reflector housing 12. The fixture mount plate 22 has a plurality of tabs 24 extending from a peripheral edge thereof providing a portion of a splice chamber between the fixture mount plate 22 and wall mount plate 40. The reflector housing 12 also preferably comprises an aperture or knock-out therein through which wire may extend from within the reflector housing 12 or ballast housing 80. The wire then extends through an opening formed by a beveled edge of a wire shield door 56 and fixture mount plate 22.

Figure 4:
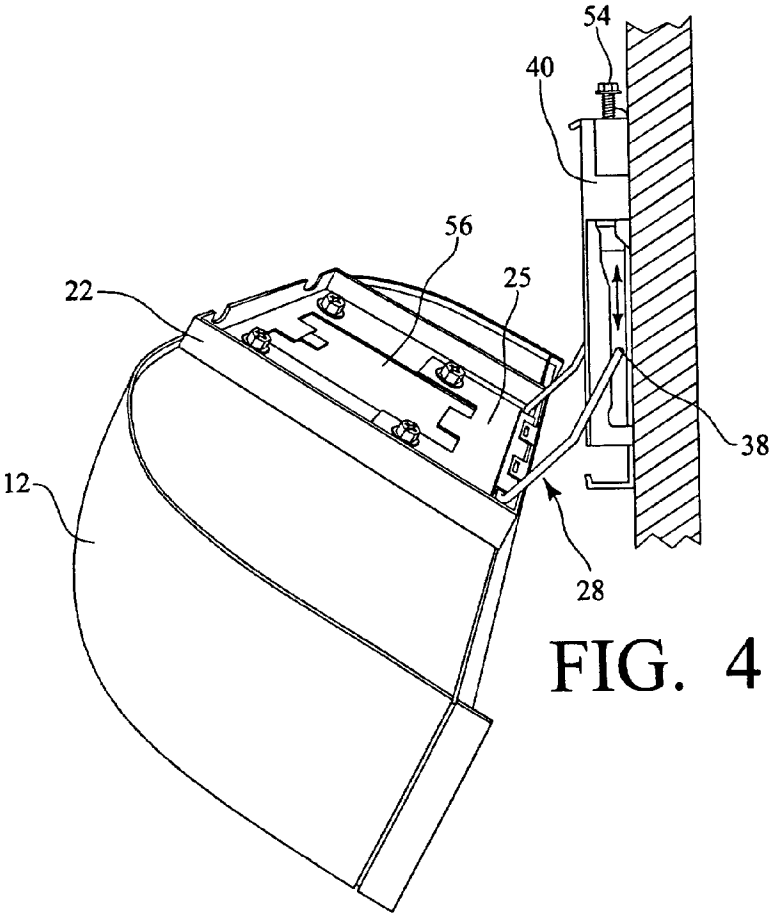
FIG. 4 shows a side perspective view of the wall mount system of the present invention in the open position.

As shown in FIGS. 2,4,9 the wire shield door 56 has a bent leg 57 extending therefrom and a ledge 58 along a lower edge of the wire shield door 56. The door 56 is positioned between the fixture mount plate 22 and the ballast housing 80 or reflector housing 12 such that the ledge 58 rests on an opening of either of the housings 12,80 depending on which embodiment is being used. The wire shield door allows access to an integral splice chamber without opening the fixture mount plate 22 from the wall mount plate 40. As shown in FIG. 9, the leg 57 is depressed providing clearance so that the wire door shield 56 may be removed.

Figure 3:
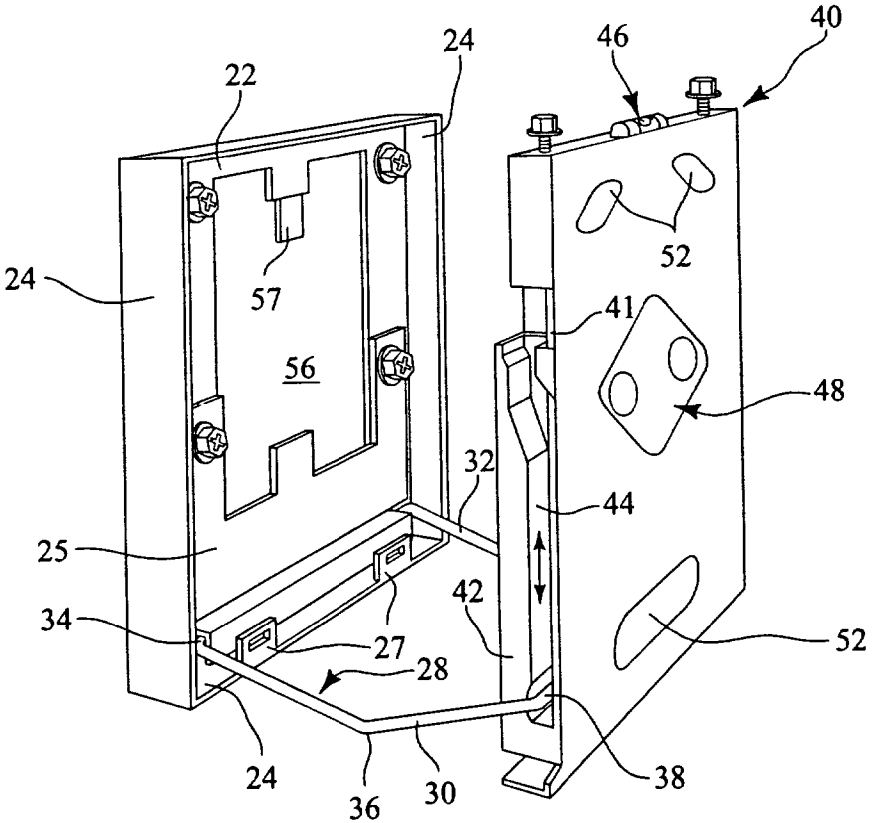
FIG. 3 shows a rear perspective view of the wall mount system of the present invention in the open position.

Referring to FIGS. 2–4, rotatably connected between the fixture mount plate 22 and surrounding brackets 27 is a wireform 28 having first and second arms 30, 32 and a third arm 34 making the wireform 28 substantially U-shaped. More specifically, a bracket 25 is connected to the fixture mounting plate 22 and within surrounding brackets 27 such that the third arm 34 is disposed between the bracket 25, the surrounding bracket 27, and the fixture mount plate 22 which in combination form a conduit wherein the third arm 34 is rotatably received. First and second arms 30, 32 preferably each have an elbow 36 therein bent at least about five degrees and inwardly extending fingers 38, opposite the third arm 34.

As best seen in FIG. 3, opposite the fixture mount plate 22 is a wall mount plate 40 having a substantially square shape and having an area slightly smaller than the fixture mount plate 22. Extending from parallel vertical edge 41 of the wall mount plate 40 are finger brackets 42. Each finger bracket 42 and the adjacent vertical edge 41 form a vertically disposed slot 44 wherein fingers 38 are slidably positioned. The vertically disposed slots 44 preferably have an open upper portion wherein the fingers 38 may be "started" in the slots 44. In a closed position, the fingers 38 move upward such that the wall mount plate 40 fits within the fixture mount plate 22.

Along a top surface of the wall mount plate 40 is a level bubble 46 which aids in installation of the wall mount plate 40. A knock-out plate 48 is located in the wall mount plate 40 through which, when removed, wire can pass from a wall conduit or junction box. Extending from an inner surface of the wall mount plate 40 is a gasket 50, as depicted in FIG. 2. The gasket 50 is preferably formed from foam, rubber, plastic, or some other water resistant material. The gasket 50 extends preferably parallel to three sides of the wall mount plate 40 to prevent weather elements from entering a splice chamber created when the wall mount plate 40 and fixture mount plate 22 are disposed in a closed position. Also disposed in the wall mount plate 40 is a plurality of bolt apertures 52, shown in FIG. 3 for fixably attaching the wall mount plate 40 to a building facade.

With the wall mount plate 40 mounted to a building wall the wireform fingers 38 are placed in upper portions of slots 44. The wireform 28, which is rotatably connected to the fixture mount plate 22 and reflector housing 12, is pulled to the bottom of the slot 44 by the weight of the reflector housing 12. When the fixture 10 is opened during initial wiring or installation, the elbows 36 of wireform 28 support the weight of reflector housing 12 in a manner such that the reflector housing 12 does not contact the building facade. This protects the lens 20, finish of the reflector housing 12, as well as the electrical components therein. When the luminaire 10 is initially wired, the reflector housing 12 is hung by the fixture mount plate 22 and wireform 28 to the wall mount 40. Moreover, this design provides support for the reflector housing 12 so that an installer's hands are free to connect the wall conduit wires and power supply wires. When the fixture 10 is closed, the wireform fingers 38—remain positioned at the bottom of the channel 44 and the arms 30, 32 rotate upwards such that they are parallel with the slots 44, vertically disposing the wireform 28 such that the fixture mount plate 22 encloses the wall mount plate 40 compressing the gasket 50 and creating the integral splice chamber therebetween. Wire connectors or wire-nuts may be disposed in the splice chamber eliminating the need for a junction box. With the fixture 10 in the closed position, screws 54 may be disposed through the top surfaces of the wall mount plate 40 and fixture mount plate 22 to lock the fixture 10 in the closed position.

Hinged Ballast Tray

In a first embodiment, the fixture mount plate 22 is directly attached to the reflector housing 12 as depicted in FIGS. 2, 4. Within the reflector housing 12 is a hinged ballast tray 60 shown in FIGS. 5, 6 having a power supply 62, ballast 64, reflector 66, lamp socket 68, lamp 70, and plurality of wires 72. The power supply 62 is in electrical communication via wires 72 with the ballast 64, the lamp socket 68 and lamp 70. The lamp 70 is preferably a HID lamp comprising a metal halide bulb but may be any other type of lamp known to those skilled in the art. The reflector 66 is substantially bowl shaped and preferably formed of polished and/or segmented specular aluminum reflectors. However, various other materials may be used to form the reflector 66. The hinged ballast tray 60 is hinged along a side to provide easy access to technicians. However, it is anticipated that due to the modular design of the hinged ballast tray 60, the entire tray 60 may be replaced when a component located thereon fails.

Connected beneath the reflector housing 12 is the lens tray 18. The lens tray 18 is preferably rectangular shaped with a plurality of screw holes disposed about the perimeter of the tray 18. The lens tray 18 further has a lens aperture 19 which is preferably rectangular in shape. As seen in FIG. 6, disposed within the lens aperture 19 is a lens ledge 74 upon which a lens 20 is positioned, as shown in FIGS. 6 and 8. The lens 20 is preferably formed of a prismatic glass or tempered flat glass and, in combination with reflector 66 directs light from the HID metal halide lamp 70. Although FIG. 8 depicts an alternative embodiment utilizing the inventive design hereof, the modular characteristics and construction of the reflector housing 12 and lens tray 18 may be shared such that the reflector housing and lens tray may be used with or without a ballast housing, described in the second embodiment.

Thermal Isolation System

Copious amounts of heat may be generated by the lamp and power supply of landscape luminaires, especially when the lamp is a large lamp, for example a 400 watt lamp. The considerate amounts of heat created by larger lamps can be harmful to the electronic components of the lamp and can, under some circumstances, lead to failure of those components.

In order to deal with this problem a second embodiment of the present invention comprises a thermal isolation system wherein a modular housing design is used to separate the reflector housing and lamp from the electronic components within a ballast or electronics housing. Thus, heat from the reflector housing and lamp therein is isolated from electrical components in the ballast housing.

Referring to FIGS. 7 and 8, an electronics or ballast housing 80 has a substantially extruded semi-circular surface 81 with a flat top portion 82. Along the rounded surfaces 81 of the housing 80 are a plurality of vents 84 for dissipating heat. The housing 80 has a first and a second side 86, 88 forming an enclosed area within the housing area 80. Extending from the semi-circular surface 81 and flat top portion 82 adjacent the edge of the first side 86 is a flange 94. The flange 94 operably connects with reflector housing 12 and provides a seal therebetween.

On the first side 86 of the ballast housing 80 is an aperture 90 which may be a plurality of shapes so long as the lamp 70 may fit therethrough. Disposed about the aperture 90 is a fixture bracket 92 which may be a plurality of shapes so long as the lamp 70 fits therethrough. Preferably, the bracket 92 fully encloses the aperture 90 to better seal the components within the ballast housing 80. The bracket 92 may also have a plurality of screw apertures extending inward from the bracket sides through which screws 171 may be placed to hold the lamp socket 169 and reflector housing 12. It is to be noted that the overall design of the embodiment shown herein incorporates similar design characteristics for the bracket and aperture 92, 90 as that of the wall mount plate 40 and fixture plate 22 so that they are interchangeable and truly modular in design.

The first and second sides 86, 88 and the semi-circular housing surface 81 define an opening which may be rectangular and wherein a ballast tray 96 may be disposed. The ballast tray 96 has a plurality of apertures wherein screws maybe positioned to attach the ballast tray 96 to the ballast housing 80. Disposed between the ballast tray 96 and the ballast housing 80 may be a gasket 17 which provides a seal therebetween.

Positioned on the ballast tray 96 may be a power supply 162, a ballast 164, and a plurality of wires not shown. The wires provide electrical communication between the power supply 162, the ballast 164, and a lamp socket 168. The lamp socket 168 is connected to a socket bracket 169 and the fixture bracket 92 from an inner portion of the ballast housing 80 by a plurality of fasteners, such as threaded screws 171. The wires preferably extend through the second side 88 of the ballast housing 80 and fixture mount plate 22 and are connected to wires extending from a building wall. Also preferably located on the second side 88 of the ballast housing is a fixture mount plate 22. As described above the fixture mount plate 22 has a wireform 28 extending therefrom being slidably and pivotably connected a wall mount plate 40 connected to a building facade. The wires in the ballast housing 80 and the power wires extending from the building may be connected by connectors or wire-nuts disposed in the splice chamber defined by the fixture mount plate 22 and wall mount plate 40 when the fixture 10 is in the closed position. A lamp 70 disposed in the lamp socket 168 passes through the ballast aperture 90 and into a reflector housing 112. Within the reflector 166 may be a lens tray 18, a lens 20, and a gasket 17 providing a seal between the reflector housing 12 and lens tray 18. The housing 12 and lens tray 18 are preferably of the same design as the first embodiment wherein the housing 12 may be interchangeable between the low wattage design of the first embodiment and the higher wattage design of the second embodiment.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

We claim:

1. A thermal isolation luminaire and wall mount system, comprising:

a wall mount plate having a pair of vertically disposed parallel slots therein;

a fixture mount plate opposite said wall mount plate and rotatably connected to a wireform;

said wireform slidably connected to said wall mount plate within said slots.

2. The thermal isolation luminaire and wall mount system of claim 1, further comprising a reflector housing connected to said fixture mount plate.

3. The thermal isolation luminaire and wall mount system of claim 1, said wireform having a first arm, a second arm, and a third arm being substantially U-shaped.

4. The thermal isolation luminaire and wall mount system of claim 1, said wireform having a first and a second elbow.

5. The thermal isolation luminaire and wall mount system of claim 1, further comprising a ballast housing connected to said fixture mount plate.

6. The thermal isolation luminaire and wall mount system of claim 5, further comprising a reflector housing fixably attached to said ballast housing.

7. The thermal isolation luminaire and wall mount system of claim 1, said wall mount plate having a gasket therein extending along three edges of said wall mount plate.

8. The thermal isolation luminaire and wall mount system of claim 1, further comprising a modular hinged ballast tray.

9. The thermal isolation luminaire and wall mount system of claim 8, said hinged ballast tray comprising a power supply, a ballast, a reflector, a lamp socket, and a lamp thereon in electrical communication.

10. A thermal isolation luminaire and wall mount system, comprising:

a wall mount plate having vertically disposed parallel slots;

a fixture mount plate operably connected to a ballast housing;

a substantially U-shaped wireform having elbows therein rotatably connected to a fixture mount plate and slidably connected within said wall mount plate slots; and, a reflector housing operably connected to said ballast housing.

11. The thermal isolation luminaire and wall mount system of claim 10, said ballast housing having a plurality of vents.

12. The thermal isolation luminaire and wall mount system of claim 10 aid ballast housing having a ballast tray therein.

13. The thermal isolation luminaire and wall mount system of claim 11, said ballast tray comprising a ballast and a power supply in electrical communication.

14. The thermal isolation luminaire and wall mount system of claim 13, said ballast housing further comprising a lamp socket in electrical communication with said power supply and said ballast.

15. The thermal isolation luminaire and wall mount system of claim 10, said reflector housing having a reflector and a lamp therein.

16. The thermal isolation luminaire and wall mount system of claim 15, further comprising a lens tray and lens seated therein fixably attached to along a lower edge of said reflector housing.

17. The thermal isolation luminaire and wall mount system of claim 15, wherein said lamp passes through an aperture in said ballast housing and into said reflector housing.

18. A thermal isolation luminaire and wall mount system, comprising:

a wall mounted luminaire having a modular hinged ballast tray therein said modular hinged ballast tray having a power supply, a ballast, a lamp socket and a lamp disposed thereon in electrical communication.

19. The thermal isolation luminaire and wall mount system of claim 18 further comprising a reflector mounted thereon.

20. A thermal isolation luminaire and wall mount system, comprising:

a wall mount plate, said wall mount plate being substantially square and having parallel slots disposed along vertical edges of said plate;

a fixture mount plate being substantially square and having a wireform rotatably mounted to said fixture mount plate;

said wireform having a first arm, a second arm, and a third arm defining a substantially U-shaped configuration and being slidably connected to said wall mount plate;

a ballast housing having a ballast tray disposed therein, said ballast tray having a power supply and a ballast thereon in electrical communication;

a lamp socket and lamp disposed in said ballast housing and in electrical communication with said power supply and ballast; and, a reflector housing having a reflector therein and a lens tray connected along a lower edge of said reflector housing, said lens tray having a lens seated in said lens tray.

21. A thermal isolation luminaire, comprising:

a ballast housing having a hinged ballast tray disposed therein, said ballast tray having a power supply and a ballast thereon in electronic communication;

a reflector housing having a reflector therein and a lens tray, a lens being seated in said lens tray;

a lamp extending from said ballast housing to within said reflector housing;

said ballast housing and said reflector housing being operably connected.

22. A thermal isolation luminaire and wall mount system, comprising:

a ballast housing having a ballast tray disposed therein, said ballast tray having a power supply and a ballast thereon in electronic communication;

a reflector housing having a reflector and a lens tray therein, a lens being seated in said lens tray;

a lamp extending from said ballast housing to within said reflector housing;

said ballast housing and said reflector housing being operably connected;

a wall mount plate having parallel slots disposed along vertical sides of said plate;

a fixture mount plate fastened to said ballast housing;

a wireform rotatably connected to said fixture mount plate and slidably connected to said wall mount plate.

23. A luminaire mounting assembly, comprising:

a wall mount plate;

a complementary fixture mount plate connected to said wall mount plate;

a wireform supporting the hanging weight of a housing, said wireform slidably connected to one of said wall mount plate and said fixture mount plate and rotatably connected to the other of said wall mount plate and said fixture mount plate.

24. The luminaire mounting assembly of claim 23, said housing comprising a reflector housing.

25. The luminaire mounting assembly of claim 23, said housing comprising a ballast housing.

26. The luminaire mounting assembly of claim 23, said housing comprising both a ballast assembly and a reflector assembly.

27. The luminaire mounting assembly of claim 23, said wireform being substantially U shaped.

28. A luminaire mounting assembly, comprising:

a wall mount plate;

a complementary fixture mount plate supported by said wall mount plate;

a wireform rotatably connected to one of said wall mount plate and said fixture mount plate and slidably connected to the other of said wall mount plate and said fixture mount plate;

a fixture comprising at least a reflector assembly and a ballast assembly.

29. A luminaire mounting assembly, comprising:

a wall mount plate;

a complementary fixture mount plate supported by and opening relative to said wall mount plate;

a wireform connecting said wall mount plate and said complementary fixture mount plate;

said wall mount plate and said complementary fixture mount plate defining an integral wire splice box in a closed position.

30. The luminaire mounting assembly of claim 29 further comprising a ballast housing connected to said fixture mount plate.

31. The luminaire mounting assembly of claim 30 further comprising a modular hinged ballast tray within said ballast housing.

* * * * *